US009581403B2

(12) United States Patent
Hayes

(10) Patent No.: US 9,581,403 B2
(45) Date of Patent: Feb. 28, 2017

(54) BIPOD

(71) Applicant: S. Kyle Hayes, Mission Viejo, CA (US)

(72) Inventor: S. Kyle Hayes, Mission Viejo, CA (US)

( * ) Notice: Subject to any disclaimer, the term of this patent is extended or adjusted under 35 U.S.C. 154(b) by 0 days.

(21) Appl. No.: 14/663,874

(22) Filed: Mar. 20, 2015

(65) Prior Publication Data

US 2016/0273863 A1 Sep. 22, 2016

(51) Int. Cl.
*F41A 23/08* (2006.01)
*F41A 23/10* (2006.01)

(52) U.S. Cl.
CPC ..... *F41A 23/08* (2013.01); *F41A 23/10* (2013.01)

(58) Field of Classification Search
USPC .... 248/163.1, 431, 166, 168, 169, 170, 171; 42/94; 89/37.01, 37.03, 37.04, 37.09, 89/40.06
See application file for complete search history.

(56) References Cited

U.S. PATENT DOCUMENTS 5,102,078 A * 4/1992 Nordeng ..... E04G 1/34 182/186.1
5,542,639 A * 8/1996 Wixey ..... B25H 1/04 108/117
5,913,668 A * 6/1999 Messer ..... F41A 23/16 42/94

* cited by examiner

*Primary Examiner* — Alfred J Wujciak

(57) ABSTRACT

An apparatus for stabilizing a device includes a rail, a first carriage, a second carriage, a first leg housing, and a first linking member. The rail is configured for attachment to the device and includes a length extending from a distal end and a proximal end. The first carriage is configured to slidably receive the rail. The second carriage is configured to slidably receive the rail. The first leg housing includes a first upper end pivotally coupled with a first portion of the first carriage and a first mount disposed distal to the first upper end. The first linking member includes a first distal end pivotally coupled with the first mount and a first proximal end pivotally coupled with a first portion of the second carriage.

19 Claims, 10 Drawing Sheets

BIPOD

FIELD

The present invention relates to bipods for stabilizing an attached device such as a firearm and more particularly to a bipod, which permits single-handed deployment and adjustment of height and angulation of the attached device.

BACKGROUND

The word "bipod" is derived from the Latin and Greek roots "bi" and "pod" meaning "two" and "foot" respectively. Bipods may be used to stabilize a variety of devices that require steadying during use, such as, for example, weapons, photographic equipment, and videographic equipment.

A bipod may be used as an attachment for a firearm to provide stability and a steady plane while aiming and shooting. The created stability is intended to help steady the firearm during "gun laying" or aiming in order to ensure and increase accuracy. Gun laying involves moving the axis of the bore of the barrel in two planes, namely the horizontal and vertical planes. A gun is traversed—rotated in a horizontal plane—to align it with the target, and elevated—moved in the vertical plane—to range it to the target. The bipod provides significant stability along the two axes of motion.

The basic concept of a bipod dates back to pre-20th century times. The Harris bipod, an early example of which may be found in U.S. Pat. No. 3,327,422 to Harris, quickly became an industry standard. The Harris bipod includes a mount attached to the underside of the fore-end of the stock of the firearm using a threaded swivel as a fastener. A clamp grips both sides of the swivel with pins that lock into the holes of the swivel. Tightening a screw on the clamp causes it to be pulled downward and forces it to squeeze on the swivel through a hole to prevent the pins from dislodging. The mount then has two legs that are attached on pivot points with springs attached along the leg and back to the mount. This allows the legs to be pivoted downward past a point where the spring pulls the legs into a position with resistance to keep them from folding up; however, the legs do not lock. The legs in the folded up position run parallel to the barrel in order minimize the profile and therefore minimize snagging on objects along the way when moving the firearm from one shooting position or location to another. In addition, this makes storing the firearm easier with the bipod attached.

Continuing with the Harris bipod, the legs are formed as tubes within tubes that allow the legs to be extended. The leg extensions have grooves cut in them to extend the legs in discreet increments to raise the height. A spring-loaded mechanism locks into the grooves. This allows some variation in setting the height of the bipod to accommodate the shooter's preference to accommodate his or her anatomy for a more comfortable position to make a shot. The legs are spring-loaded to retract to quickly stow the legs for movement. Stowing the legs involves pushing the legs forward past the spring's point of resistance where the spring begins to pull the legs upward. The legs have feet or caps on their ends made of rubber that when set on a surface provide a grip and added stability in order to steady the firearm for a shot. Leapers, Inc. manufactures the UTG Bipod with similar features as the Harris bi pod.

Another popular bipod, manufactured by B&T Industries, LLC, is the Atlas bipod, an example of which may be found in U.S. Pat. No. 7,614,174 to Beltz. This particular design utilizes a "QD" or quick disconnect and connect mechanism to secure to a rail mounted to the underside of the fore-end of a stock on a firearm. The legs of this design can be angled forward at preselected angles based on a pin mechanism that uses a spring-loaded button that interfaces with a corresponding cog on the base of the bipod. The design also has leg extensions to adjust the height of the bipod. The leg extensions utilize a spring-loaded collar that is pulled downward along the axis of the leg to release and pull the leg extensions into position. The legs have corresponding notches to lock into various settings for adjustment. This allows the legs to be extended in a telescopic fashion to a desired level. This bipod is also available with modular extensions that can be installed to increase the height and reattach the feet using an Allen key. A variety of feet are also available. The Atlas bipod also allows the mount to swivel so the firearm can be panned left to right for moving targets. In addition, the firearm can also be canted since the mount can swivel on an axis parallel to the barrel. Actuation of the legs may be performed using one hand, but it is very difficult to do while the firearm is shouldered since the shooter has to reach far forward unless the bipod is mounted backwards on the mount.

GG&G manufactures the XDS bipod, which includes features of both the Harris bipod and the Atlas bipod. It also utilizes a QD mechanism to connect to a rail. The legs extend through a threaded knob that when turned releases the legs to telescopically extend the legs. The legs are rotated down into position and can be locked via a mechanism of a lever that is spring loaded. Depressing the lever releases the lock so the legs can be folded up and stowed for movement. The legs of this design can also be angled forward like the Atlas bipod; however, there is only one setting at 45 degrees.

Versa-Pod manufactures a variety of bipods including the 150 Series of bipods, an example of which being the 150-052 bipod. This bipod requires a special adapter to be placed on the firearm for mounting which may be attached in turn to a standard Picatinny rail. The design utilizes a ball joint to rotate or angle the firearm. This ball joint allows for panning the firearm during tracking while a screw is provided that can be tightened to eliminate movement as desired. The legs of this design are spring loaded in a direction of extension rather than retraction. The design has a unique mechanism in which the leg, when in the folded up position, fold together forward; however when pulled down, the legs spread apart with a spring between the legs. The legs can also be folded backward. There is no positive lock on the legs.

The Mako Group manufactures a line of bipods known as the "Vertical Foregrip" w/Integrated Adjustable Quick Release bipod, examples of which may be found in U.S. Pat. Nos. 7,823,855 and 7,909,301 to Faifer, that double-functions as a single handle/forward grip that opens and converts into a bipod. A single hand can be used to deploy the bipod; however, the handle or forward grip itself cannot be folded up and stowed during movement. Some versions include an integrated flashlight mount. The design utilizes a unique slide mechanism in which a button is depressed to move it and open the feature to slide onto a rail system. Once it reaches a desired position along the rail, the shooter releases the button to allow the slide to move into a position in which a locking lug slides into one of the slots on the Picatinny rail.

With the exception of the Mako Group bipod, current designs all require the shooter or shooter in many cases to bring the firearm off the shoulder in order to use the hand that typically grips the stock or pistol grip to actuate the legs into a downward position by hand to set up for a shot. This may be critical time in which the shooter needs to setup, deploy and, steady the firearm, and acquire the target through sights or optics in order to make a shot. At this point, the target may have moved and gone to a place of cover or concealment.

Another issue with many of the current designs is the complex actuation mechanisms that must be grasped and positioned to release and extend the legs to change the set elevation. Changing the set elevation is important to bring the firearm to a comfortable position in relation to the anatomy of the shooter. In many cases, the levers are not ergonomically designed or positioned for easy actuation compatible with the anatomy of the fingers and hands. The levers have to be held while the firearm is lifted for the legs to be extended or the firearm is lifted to let the legs adjust and then locked down. A few of the bipods leg extensions are spring loaded so that when actuated extends the legs out to the furthest adjustment or they retract fully. As a result, the firearm has to be gripped and held, taking it off the shoulder until the legs can be locked.

To lock the legs, many of the current designs use extension springs that provide a positive force pulling the main legs down into position once the legs are rotated past a point where the spring acts in this downward direction. This requires the use of both hands: one hand holds the firearm while the other hand grips the leg and pulls it downward against the resisting spring past the point of resistance. This has to be repeated on the other side for the bipods where the main legs act independent of one another. Again, the firearm has to be taken off the shoulder to deploy.

The pads or feet of many of the designs use one of two types. One seems to be a rubber foot that is round but has angled or chamfered surfaces that actually interface with the ground once the legs are deployed into position. The other is a flat plate at the end of the leg that interfaces with the ground in a normal orientation once the legs are deployed. The former round rubber foot when contacted with the ground only provides one line of contact. The flat plated feet provide a surface but once the bipod is slightly tilted, which is done in most cases, still only provides one line of contact.

SUMMARY

An apparatus for stabilizing a device includes a rail, a first carriage, a second carriage, a first leg housing, and a first linking member. The rail is configured for attachment to the device and includes a length extending from a distal end and a proximal end. The first carriage is configured to slidably receive the rail. The second carriage is configured to slidably receive the rail. The first leg housing includes a first upper end pivotally coupled with a first portion of the first carriage and a first mount disposed distal to the first upper end. The first linking member includes a first distal end pivotally coupled with the first mount and a first proximal end pivotally coupled with a first portion of the second carriage.

In other features, the apparatus includes a second leg housing including a second upper end pivotally coupled with a second portion of the first carriage and a second mount disposed distal to the second upper end. The apparatus includes a second linking member including a second distal end pivotally coupled with the second mount and a second proximal end pivotally coupled with a second portion of the second carriage.

In yet other features, the apparatus includes a first locking mechanism that selectively prevents translation of the rail relative to the first carriage. In still other features, the apparatus includes a second locking mechanism that selectively prevents translation of the rail relative to the second carriage. In other features, at least one of the first and second locking mechanisms includes a locking projection that selectively engages a recess of the rail.

In still other features, the first carriage pivots about the upper end of the first leg housing, a distance between the first carriage and the second carriage changes. The first linking member includes an angle between the first proximal end and the first distal end. Positioning the second carriage towards the first carriage causes the first leg housing to pivot in a first direction. Positioning the second carriage away from the first carriage causes the first leg housing to pivot in a second direction.

In other features, the first leg housing may be positioned into at least three positions including a stowed configuration, a first deployed configuration, and a second deployed configuration. In the stowed configuration, the first leg housing is pivoted in a first direction until aligned with the rail. In the first deployed configuration, the first leg housing is pivoted in a second direction to a first angle relative to the rail. In the second deployed configuration, the first leg housing is pivoted in one of the first direction and the second direction to a second angle relative to the rail. The first leg housing may be locked in any of the at least three positions by selectively engaging at least one of a first locking mechanism of the first carriage and a second locking mechanism of the second carriage with the rail. The first carriage and the second carriage may be simultaneously positioned along the rail.

An apparatus for stabilizing a device includes a rail, first and second carriages, first and second leg housings, first and second linking members, and first and second locking mechanisms. The rail is configured for attachment to the device and includes a length extending from a distal end and a proximal end. The first and second carriages are configured to slidably receive the rail. The first and second leg housings each have an upper end pivotally coupled with the first carriage and a mount disposed distal to the upper end. The first and second linking members each have a distal end pivotally coupled with a respective mount and a proximal end pivotally coupled with the second carriage. The first and second locking mechanisms selectively prevent translation of the rail relative to the first carriage and the second carriage respectively.

In other features, the leg housings may be positioned into at least three positions including a stowed configuration, a first deployed configuration, and a second deployed configuration. In the stowed configuration, the leg housings are pivoted in a first direction until aligned with the rail. In the first deployed configuration, the leg housings are pivoted in a second direction to a first angle relative to the rail. In the second deployed configuration, the leg housings are pivoted in one of the first direction and the second direction to a second angle relative to the rail.

DETAILED DESCRIPTION

Embodiments of one or more inventions will now be described with reference to figures, wherein like numerals reflect like elements throughout. The terminology used in the description presented herein is not intended to be interpreted in any limited or restrictive way, simply because it is being utilized in conjunction with detailed description of certain features of the embodiments or inventions. Furthermore, embodiments of the inventions may include several novel features, no single one of which is solely responsible for its desirable attributes or which is essential to practicing the inventions described herein.

Figure 1:
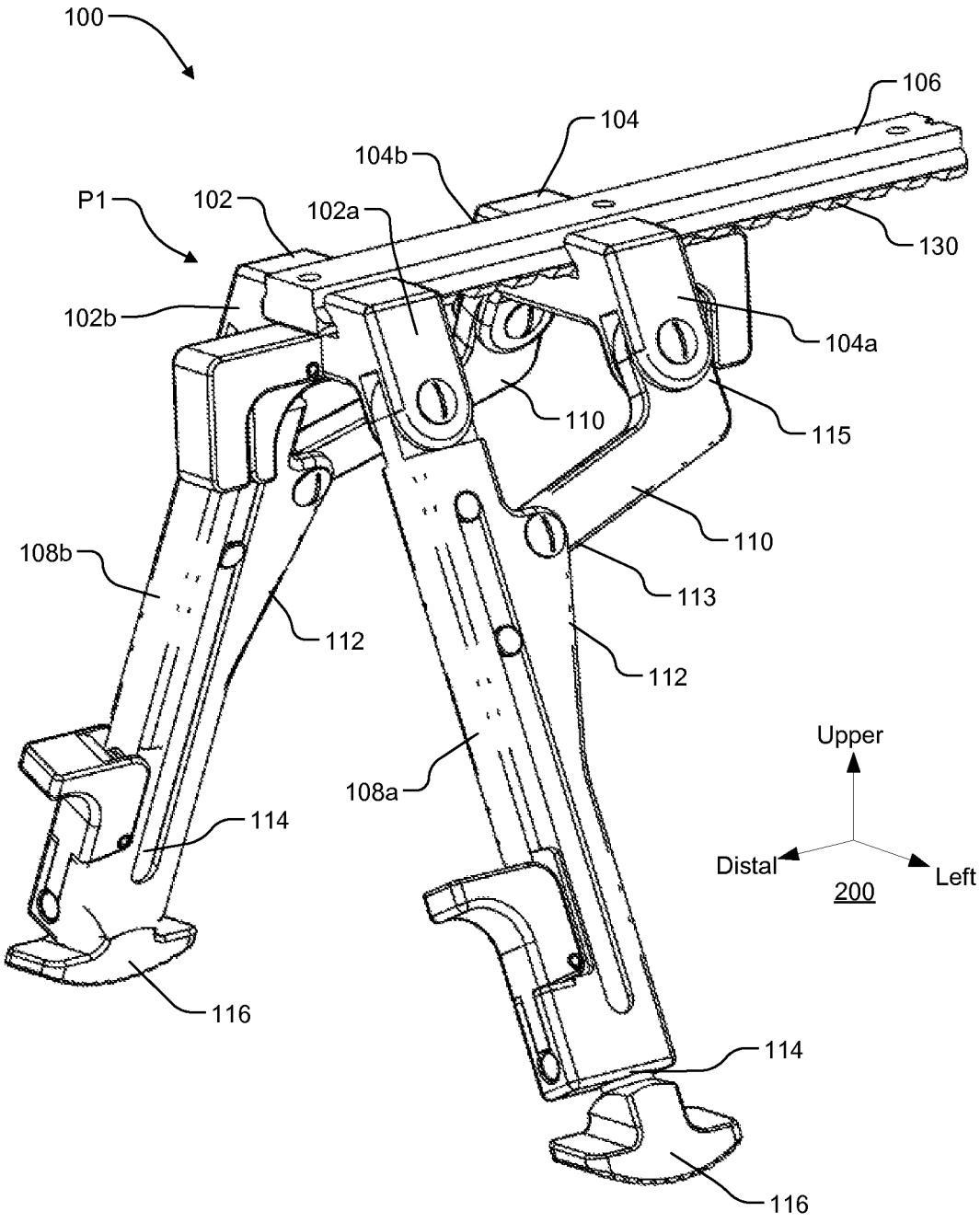
FIG. 1 is perspective view of an exemplary bipod according to the principles of the present disclosure.
Figure 2:
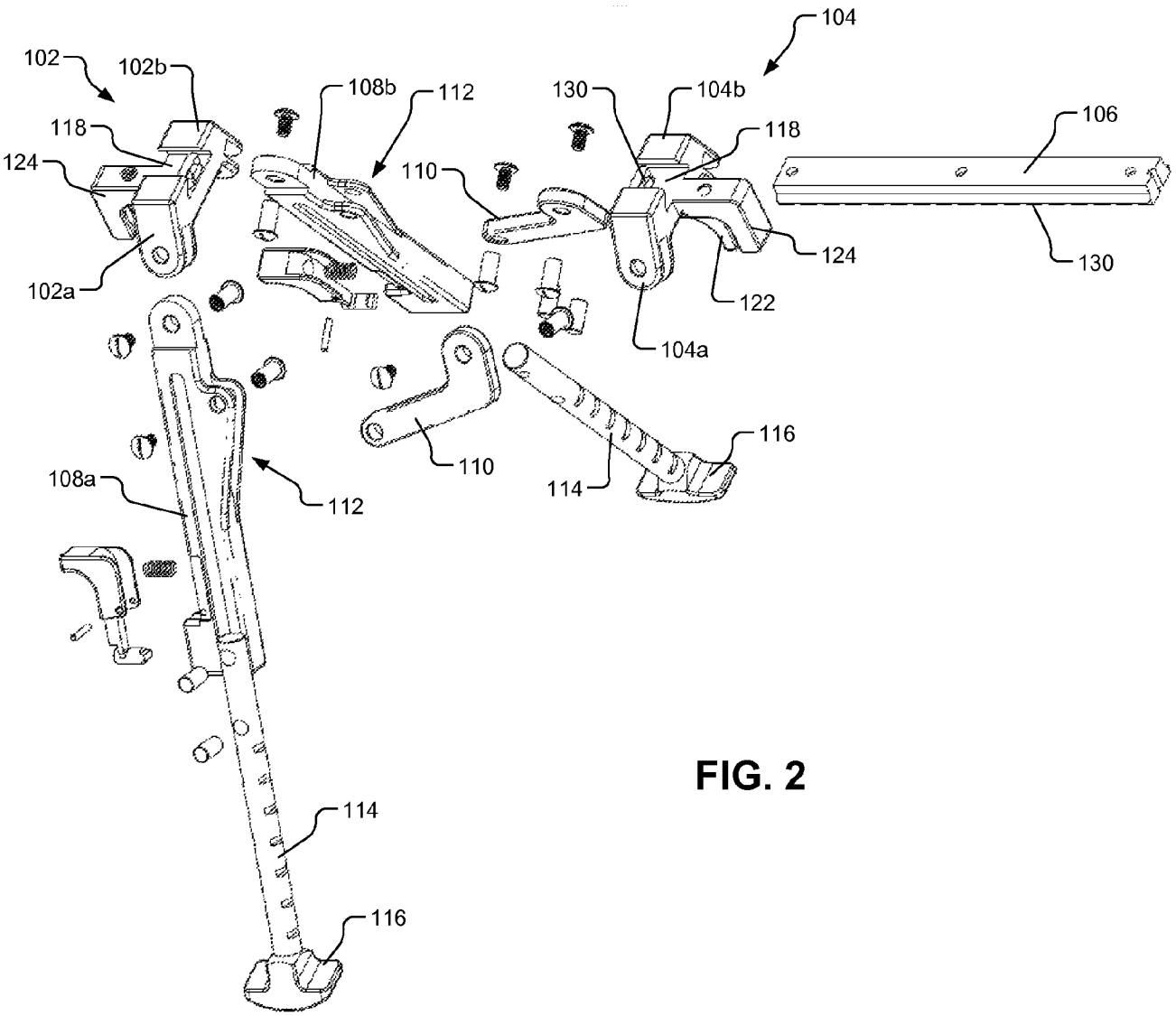
FIG. 2 is an exploded view of the exemplary bipod.
Figure 3:
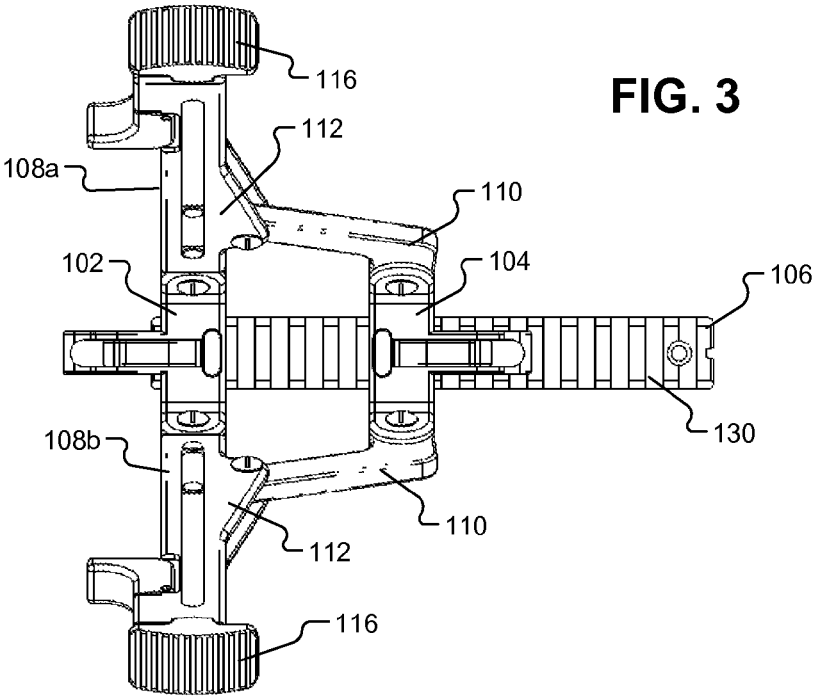
FIG. 3 is a bottom view of the exemplary bipod.
Figure 4:
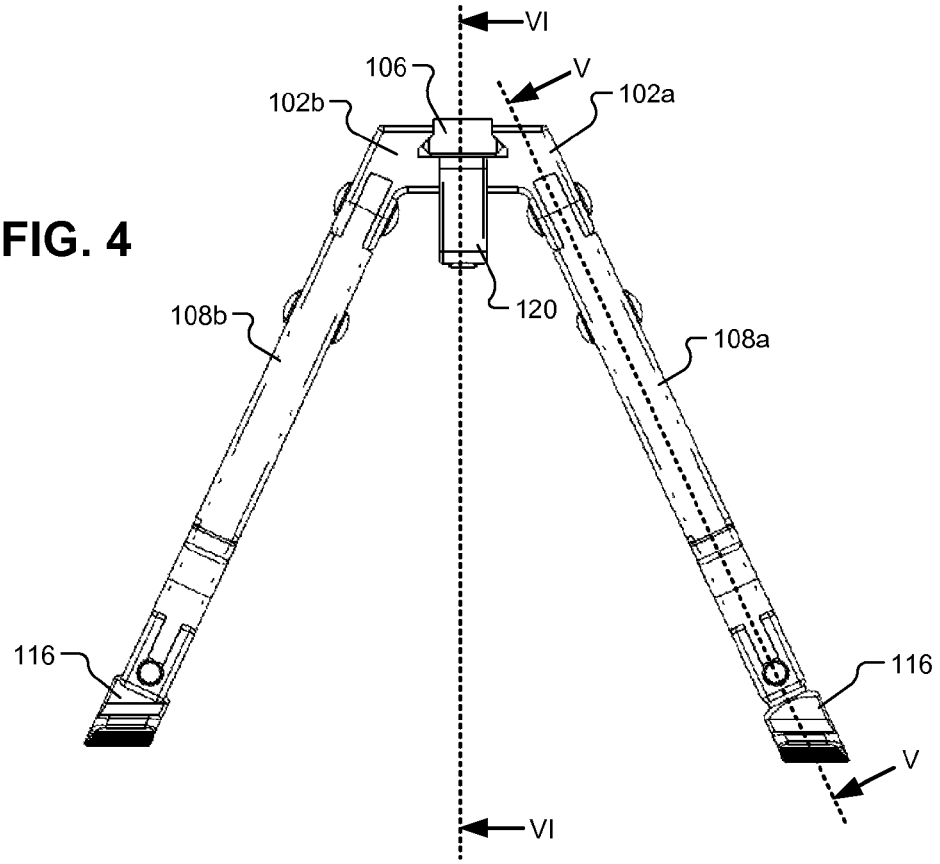
FIG. 4 is a front view of the exemplary bipod.

The words proximal and distal are applied herein to denote specific ends of components of the apparatus described herein. A proximal end refers to the end of a component nearer to an operator when the apparatus is being used as intended. A distal end refers to the end of a component further from the operator when the apparatus is being used as intended. "Left" refers to a left side of as viewed by the operator and "right" refers to a right side as viewed by the operator. "Upper" refers to the direction going away from a support surface such as the terrain, ground, or floor and "lower" refers to the direction going towards the support surface. Directional cues in this regard may be indicated by axes 200 as shown in FIG. 1.

Figure 10A:
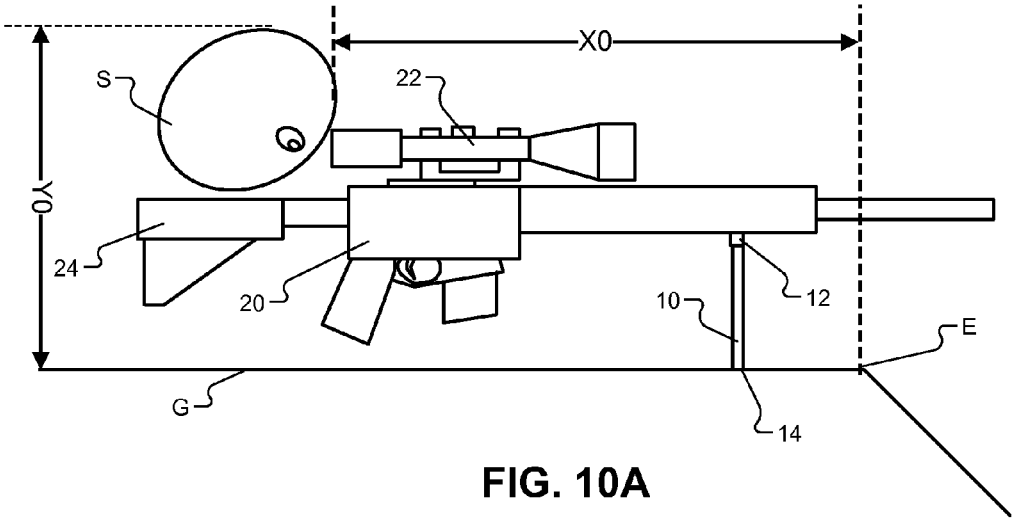
FIGS. 10A and 10B are side views illustrating a firearm attached to a prior art bipod in a deployed configuration.
Figure 10B:
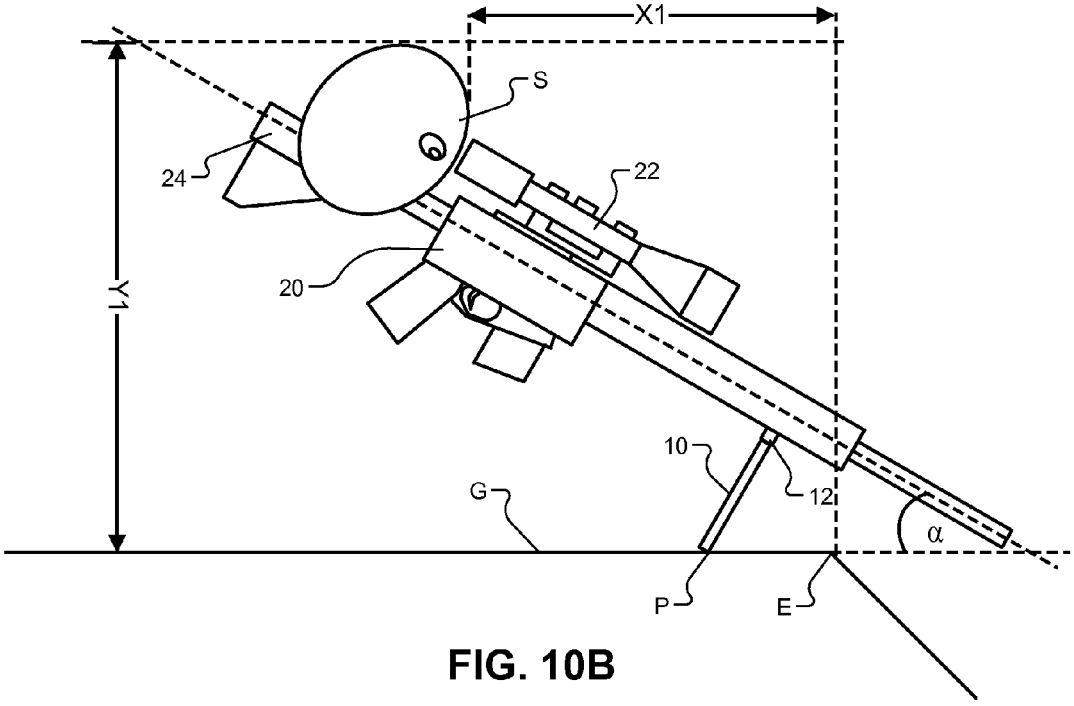

Generally, a bipod provides support to a distal end of an attached firearm. Supporting the distal end of the firearm enables the shooter to lay with the firearm and better steady the firearm while selecting and tracking a target or subject of study. A typical bipod 10 offers a fixed attachment point 12 for a firearm 20 as shown in FIGS. 10A and 10B. A shooter S may use a scope 22 to aim the firearm 20 at the target. To adjust an angle $\alpha$ downward from the shooter, such as from an elevated position as on a slope or bluff, the shooter S must pivot the entire bipod 10 about a distal end 14 of the legs, which are engaged with the ground G to form a pivot point P. Thus, to shoot downward towards a target below the shooter S, a proximal end 24 of the firearm 20 must be raised upward. Raising the proximal end 24 of the firearm 20 requires the shooter S to also rise, which in turn may increase the risk of exposure to fire from the intended target or another. For example, the shooter S may be exposed at a first height Y1 greater than an initial height Y0 when the firearm 20 is aimed along the horizon. In addition, by pivoting forward, a distance measured from the edge E of the elevated position may decrease from an initial distance X0 to a smaller distance X1. This also may increase the risk of exposure.

One advantage of the present invention includes the ability to adjust the angle of the legs relative to the firearm. Another advantage of the present invention includes the ability to translate the firearm while attached relative to the bipod. Features associated with these advantages enable the shooter to lower the body adjust the location of the pivot point of the firearm to reduce the need to raise the proximal end of the firearm, thus decreasing the risk of exposure of a shooter.

FIGS. 1-4 illustrate an exemplary bipod 100 including various features associated with these advantages. In some cases, features may be described with reference to directions indicated by the axes 200 as experienced by the shooter S when using the bipod 100 attached to the firearm 20, such as in FIGS. 11A-11D. The bipod 100 includes a first carriage 102 disposed distal to the shooter and a second carriage 104 disposed proximal to the shooter. The carriages 102 and 104 are configured to receive a rail 106, which in turn is configured to attach to a firearm along any one of the barrel, stock, or other housing used for support when laying the firearm. The rail 106 may include a Picatinny-style rail or any other type of rail (KeyMod mounted, special built, etc.) Typically, the rail 106 is mounted to the underside of the stock or a forward grip of the firearm depending on the type of firearm. More and more firearms are of the AR type, or have been designed to be modular where different fore-ends can be attached for different attach points for accessories like bipods. This allows for interchangeability or attachment of different types of components or accessories.

Figure 8A:
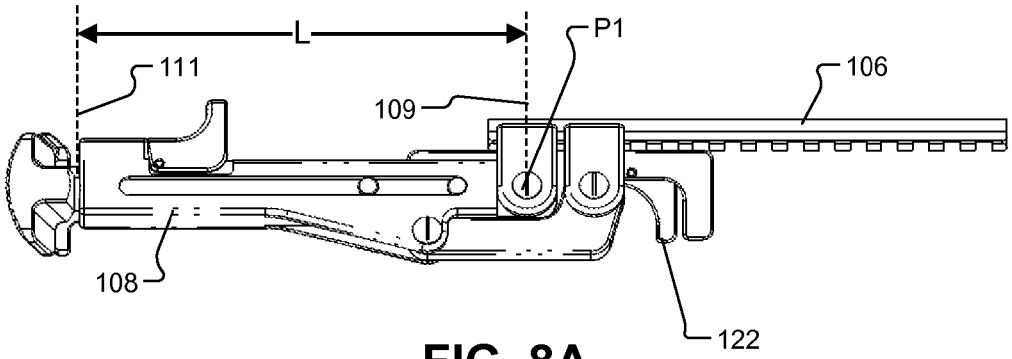
FIGS. 8A-8C are side, perspective, and bottom views of the exemplary bipod in a stowed configuration.

The bipod 100 further includes at least one leg housing although preferably a first leg housing and a second leg housing. The first and second leg housings may include, for example, a left leg housing 108*a* and a right leg housing 108*b* (collectively leg housings 108) respectively. The left and right leg housings 108*a* and 108*b* each include a length L from an upper end 109 to a lower end 111 as seen in FIG. 8A. The leg housings 108 may be substantially mirror images of one another, and therefore for simplicity may be described using the same numerals or similar numerals. The left and right leg housings 108*a* and 108*b* pivotally couple with left and right portions 102*a* and 102*b* of the first carriage 102 respectively via pins or bolts. Thus, the first carriage 102 may pivot relative to the leg housings 108 and act as a first pivot point P1 about which the firearm 20 may pivot.

Figure 8B:
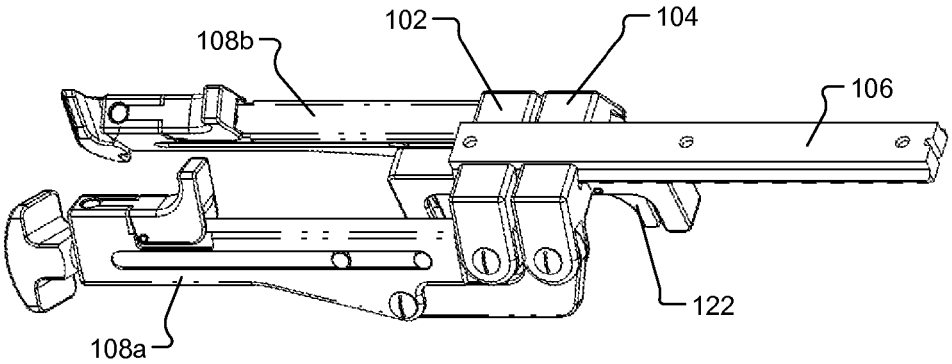
Figure 8C:
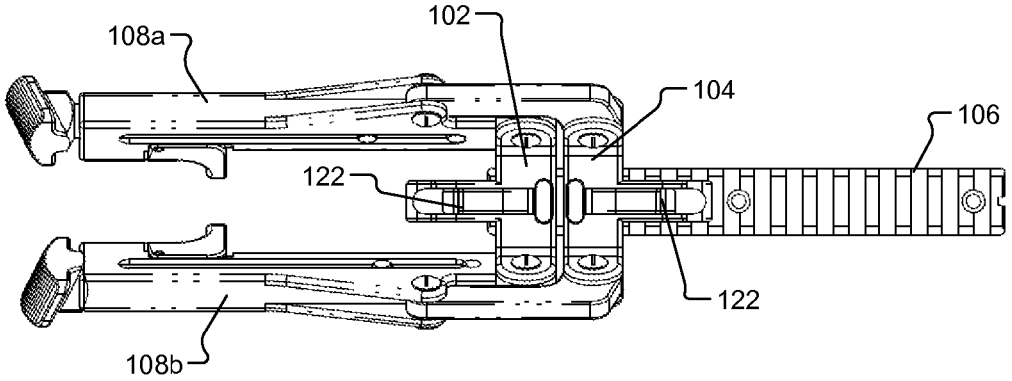

Linking members 110 operably couple each of the leg housings 108 with the second carriage 104. For example, each leg housing 108 may include a link mount 112 distal to the upper end 109 and projecting proximally to couple with a distal end 113 of each linking member 110. A proximal end 115 of each linking member 110 pivotally couples with left and right portions 104*a* and 104*b* of the second carriage 104 respectively. When in a deployed configuration as shown in FIG. 1, the leg housings 108 project away from the first carriage 102 at an angle to support the firearm attached to the rail 106, also shown in FIG. 11A. When in a stowed configuration, as shown in FIGS. 8A-8C, the leg housings 108 pivot about the first pivot point P1 towards the rail 106 for compactness. Furthermore, in any deployed configuration, leg extensions 114 may be extended from within channels of the leg housings 108. The channels may be hollowed-out portions of the leg housings 108. Each leg extension 114 may include a foot 116 (collectively feet 116) on the lower end. The feet 116 may be curved on lower surfaces and include cross cuts to provide a grip or resistance against the surface to counter the effects of recoil during shooting. This allows for faster follow up shots as repositioning to re-aim in successive shots is minimized.

Figure 5:
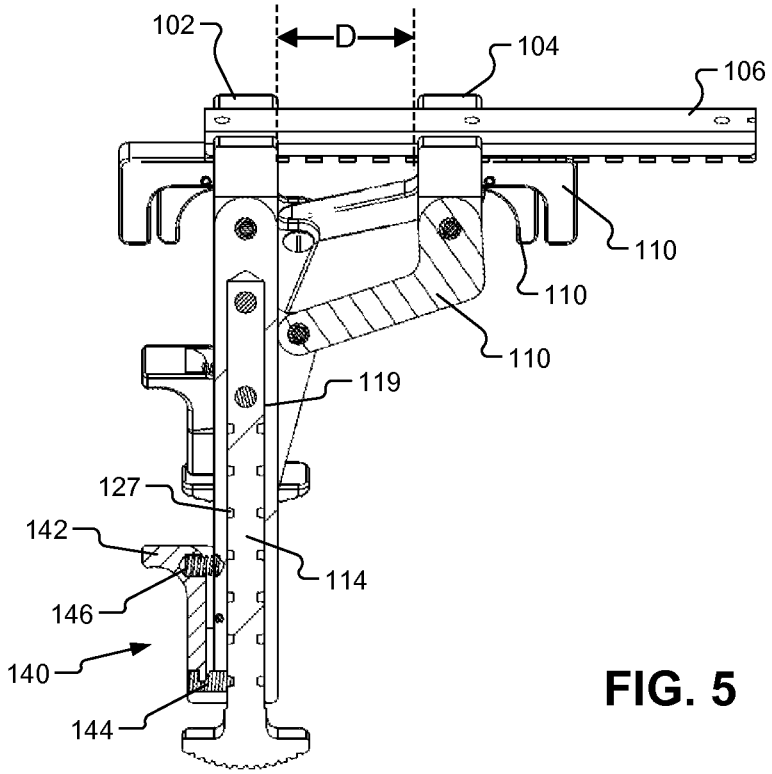
FIG. 5 is a cross-sectional view of the exemplary bipod looking into a plane V of FIG. 4.

Like the leg housings 108, the first carriage 102 and the second carriage 104 may be substantially mirror images of one another, and therefore for simplicity may be described using the same or similar numerals. Each carriage 102 and 104 includes a channel 118 configured to receive the rail 106. The channel 118 may include a dovetail profile or any other mating profile for rails known in the art including Picatinny rails. The rail 106 may freely slide within the channels 118 of the carriages 102 and 104. The first carriage 102 and the second carriage 104 may be moved independently along the rail 106. A distance D between the carriages 102 and 104, as shown in FIG. 5, may be held constant or adjusted while positioning and adjusting the bipod 100.

Figure 6:
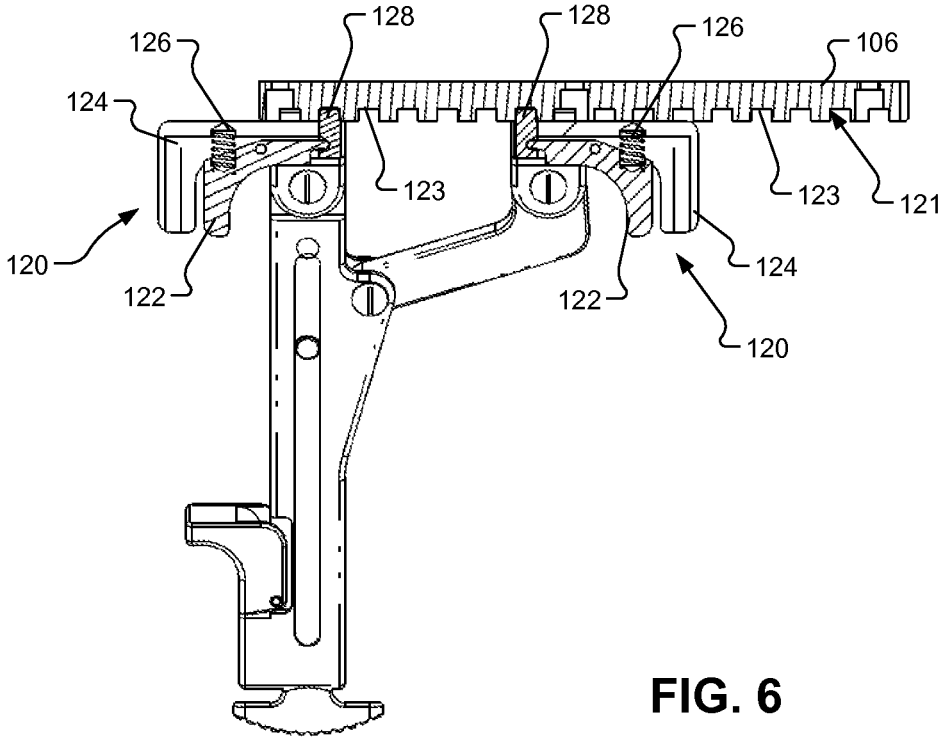
FIG. 6 is a cross-sectional view of the exemplary bipod looking into a plane VI of FIG. 4.

Each carriage 102 and 104 further includes a lock assembly 120 that is configured to lock the rail 106 in place relative to each carriage. For example, the lock assembly 120 may include a trigger 122, a stop 124, and a bias member 126 (see FIG. 6). The lock assembly 120 may engage a lower surface 121 of the rail 106 to restrict movement of the rail 106 relative to the respective carriage 102 or 104. The bias member 126 may bias the trigger 122 into contact with the lower surface 121 of the rail 106. In the present example, the lock assembly 120 is integral with the carriages 102 and 104, portions of which projecting distally away and proximally away from each carriage respectively. The trigger 122 pivotally mounts within the stop 124 and when actuated, may pivot a projecting member 128 on one end.

The projecting member 128 may extend partially into the channel 118 from the lower side of the carriage. The trigger 122 may pivot the projection 128 into and out of engagement with the lower surface 121 of the rail 106. The bias member 126 may pivot the projecting member 118 into engagement with the lower surface 121 of the rail 106. The lower surface 121 of the rail 106 may include ratchetings 123 to retain the projecting member 128 and thus lock the respective carriage in place relative to the rail 106. In other examples, the lower surface 121 may include a gripping surface that slides freely within the channel 118 and the projecting member 128 may include a mating gripping surface. In this example, no ratchetings may be provided and the engagement may be frictional rather than through interference.

As described above, the first carriage 102 and the second carriage 104 include channels 118 for receiving the rail 106. The channels 118 may be open at upper surfaces of the carriages 102 and 104. The channels 118 may include apertures 130 through which the projecting members 128 extend. The carriages 102 and 104 can be moved along the rail 106 to change position by depressing the trigger 122 and releasing the projecting members 128 from contact with the rail 106. When one of the triggers 122 is depressed, then the respective carriage 102 or 104 can move along the rail 106. For example, when the trigger 122 of the second carriage 104 is depressed, the second carriage 104 may move along the rail 106 while the first carriage 102 remains fixed. In this manner, the angle $\alpha$ may be adjusted as shown in FIGS. 11A-11D.

Each carriage 102 and 104 may move towards or away from the other carriage as the shooter S adjusts the angle $\alpha$ or the rail 106 is positioned distally or proximally or some combination of the two movements. Furthermore, once the carriages 102 and 104 are locked in position, the rail 106 may be slid distally or proximally from the shooter to adjust the location of the first pivot point P1 along the firearm. In addition, the second carriage 104 can be actuated back towards the proximal end of the rail 106 closest to the shooter to allow the leg housings 108 to be angled distally. This would aid in shooting over an edge in a downward direction. This allows the firearm to stay low while still providing the stabilizing effect for aiming. In addition, this minimizes the silhouette and exposure of the shooter as shown in FIGS. 11A-11D.

Figure 7A:
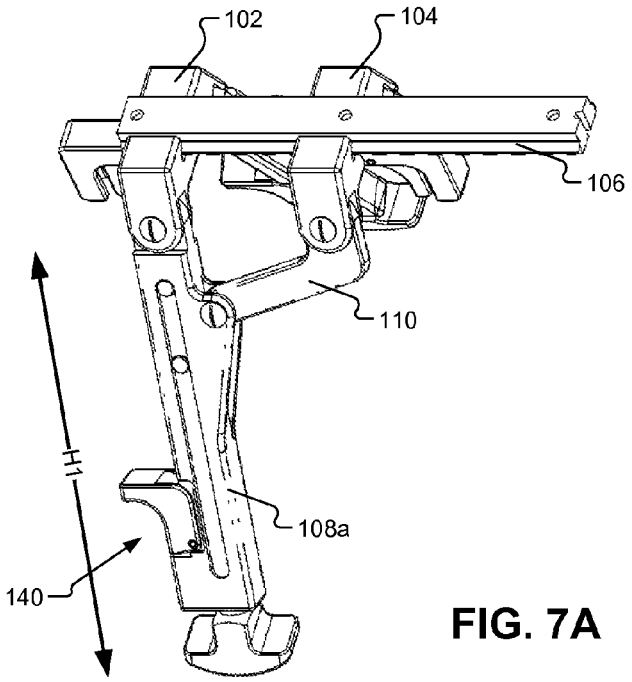
FIGS. 7A and 7B are perspective views of the exemplary bipod with leg extensions in retracted and extended positions respectively.
Figure 7B:
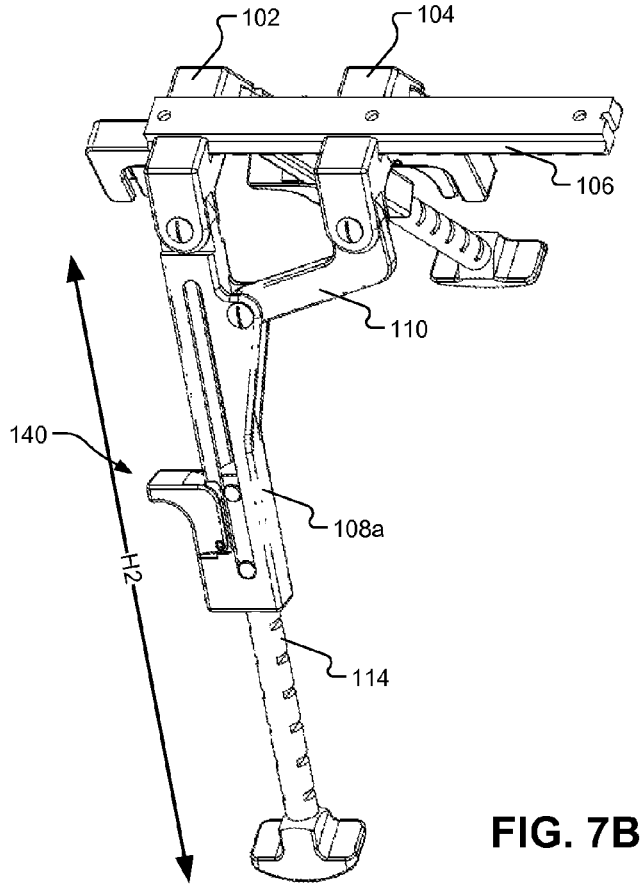

Referring again to FIG. 5, additional features of the leg housing 108 include a channel 119 configured to receive the leg extension 114. The leg housing 108 may include a retention mechanism 140 that retains the leg extension 114 within the channel 119. For example, the retention mechanism 140 may include a retention trigger 142, a retention projecting member 144, and a retention bias member 146. The retention projecting member 144 may engage with one or more recesses 127 of the leg extension 114. The retention bias member 146 may bias the retention projecting member 144 into engagement with the recesses 127. The retention trigger 142 may be depressed to release the retention projecting member 144 from the recesses 127. The leg extension 114 may descend from the channel 119 due to gravitational forces. Alternately, a deployment or retention bias member (not shown) may bias the leg extension 114 either distally or proximally relative to the leg housing 108. In this manner, the leg extensions 114 may be independently adjusted to increase or decrease a height of both the left and right sides of the bipod 100 from H1 to H2 as illustrated in FIGS. 7A and 7B.

Referring now to FIGS. 8A-8C, the bipod 100 may be positioned in a stowed configuration as shown. For example, the leg housings 108 may be pivoted about the first pivot point P1 by sliding the second carriage 104 towards the first carriage 102, decreasing the distance D therebetween them. This may be accomplished by depressing the trigger 122 of the second carriage 104 to disengage the projecting member 128 from the rail 106, sliding the second carriage 104 towards the first carriage 102, and releasing the trigger 122 to engage the projecting member 128 with the rail 106 again. In the stowed configuration, the leg housings 108 may be parallel with the rail 106. The first and second carriages 102 and 104 may be disposed anywhere along the rail 106. For example, the carriages may be moved simultaneously towards the proximal end of the rail 106 or the distal end of the rail 106.

Figure 9A:
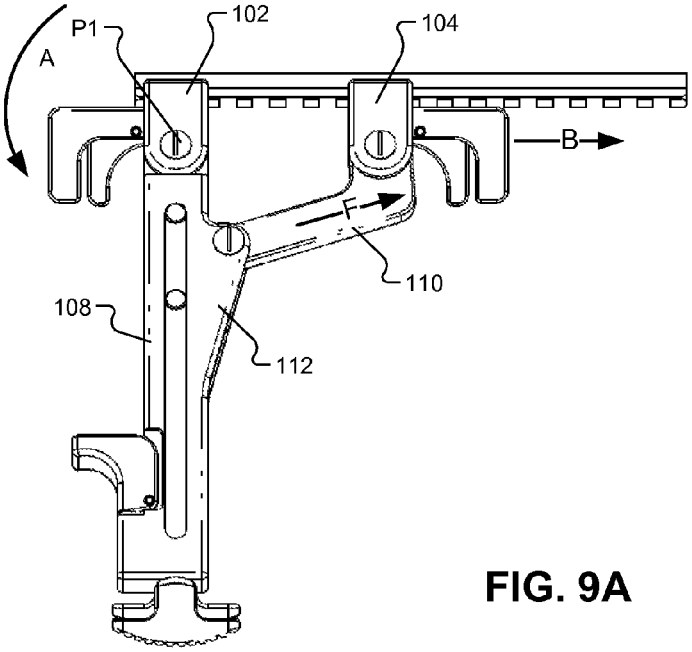
FIGS. 9A and 9B are side views of the exemplary bipod in first and second deployed configurations respectively.
Figure 9B:
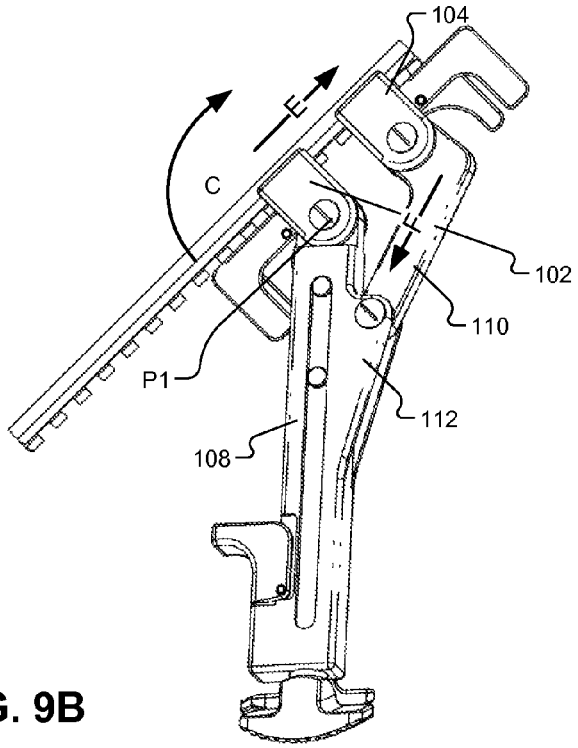

The bipod 100 may be positioned into a plurality of deployed configurations, two of which are shown in FIGS. 9A and 9B respectively. For example, in a first deployed configuration shown in FIG. 9A, the leg housings 108 may be pivoted in a first direction A about the pivot point P1 (counter-clockwise) by sliding the second carriage 104 away from the first carriage 102 and towards the proximal end of the rail 106 as indicated by arrow B. This may be accomplished by depressing the trigger 122 of the second carriage 104 to disengage the projecting member 128 from the rail 106, sliding the second carriage 104 away from the first carriage 102, and releasing the trigger 122 to engage the projecting member 128 with the rail 106 again. Pulling the second carriage 104 proximally towards the shooter will apply a force F on the linking members 110. The linking member 110 transfer the force to the mounts 112 which in turn pull the legs housings 118 down from the stowed configuration. Gravity may also aid the leg housings 118 in being drawn down from the stowed configuration.

The first and second carriages 102 and 104 may be positioned in numerous locations and at various distances D apart from one another to provide a plurality of deployed configurations. For example, in a second deployed configuration shown in FIG. 9B, the leg housings 108 may be pivoted in a second direction C about the pivot point P1 (clockwise) by sliding the first carriage 102 towards the second carriage 104 as indicated by arrow E as both carriages are also positioned proximally towards the shooter. This may be accomplished by depressing the trigger 122 of the first carriage 102 to disengage the projecting member 128 from the rail 106, sliding the first carriage 102 towards the second carriage 104, and releasing the trigger 122 to engage the projecting member 128 with the rail again 106. Alternately, the second carriage 104 may slide towards the first carriage 102 in a similar fashion as when positioning the bipod in the stowed configuration but stopping before reaching the stowed configuration. The force F may be applied to push the leg housings 108 In this manner, the angle α may also be adjusted.

Figure 11A:
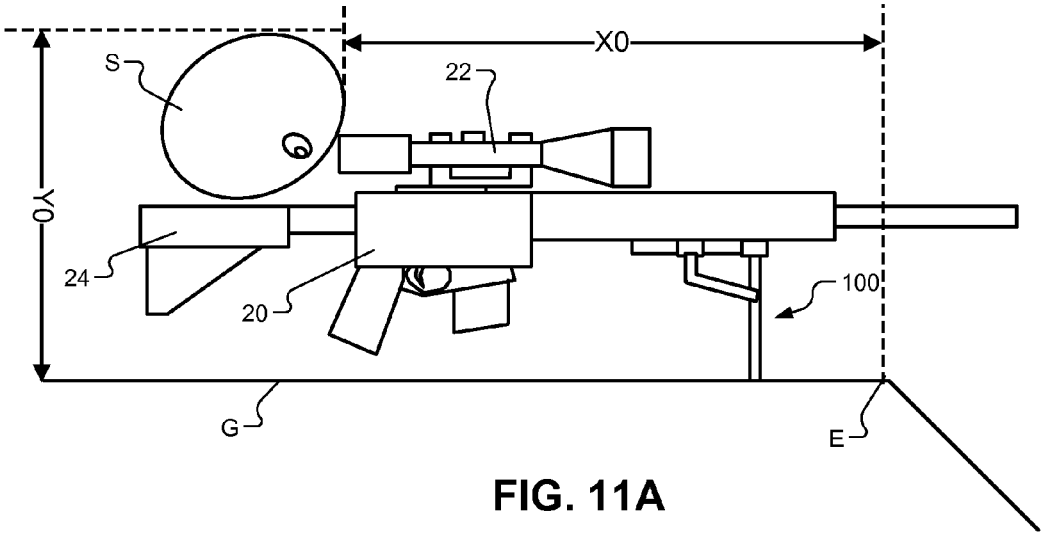
FIGS. 11A-11D are side views illustrating a firearm attached to the exemplary bipod in a plurality of deployed configurations.
Figure 11B:
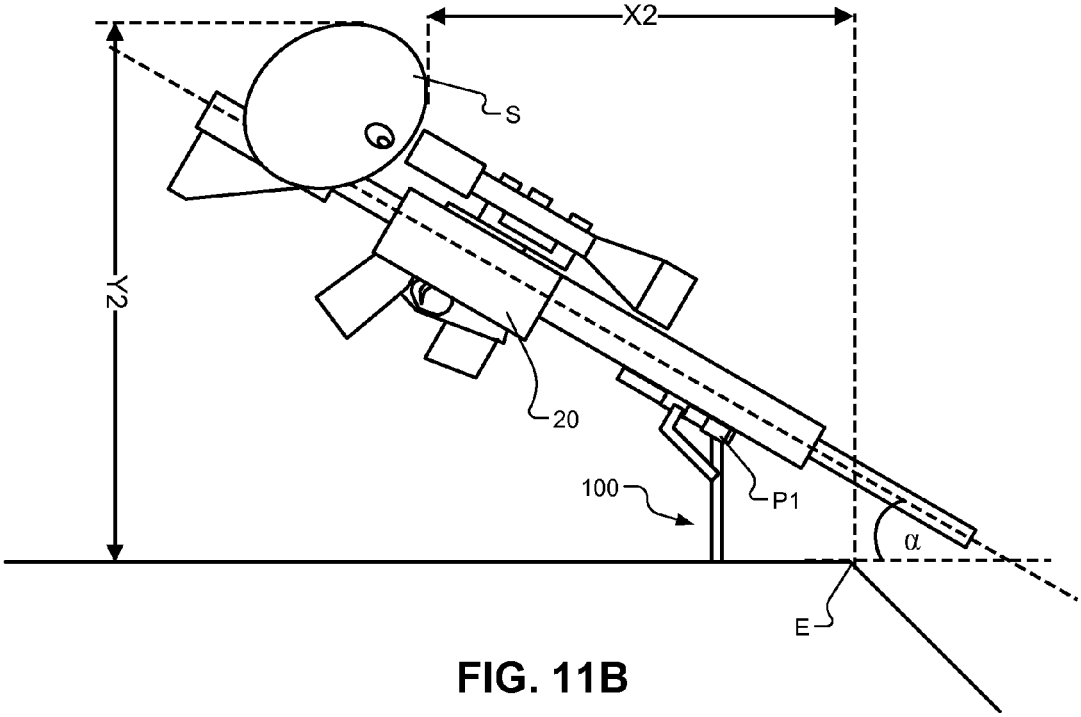

FIGS. 11A-11D illustrate some, advantages of the exemplary bipod 100 compared with prior bipods such as the bipod 10 of FIGS. 10A and 10B. In FIG. 11A, the firearm 20 is shown in substantially the same position as in FIG. 10A but with the bipod 100 attached. The shooter S has the same exposure due to height Y0 measured from the ground G and distance X0 from the edge E as in the prior art. In FIG. 11B, the firearm 20 has been pivoted on the bipod 100 as described above. The first and second carriages 102 and 104 have been positioned closer together to adjust the angle of attack α to be substantially the same as in FIG. 10B. However, because the firearm 20 is pivoted about the first pivot point P1 rather than the pivot point P at the ground G, the shooter S may hold position further from the edge E. That is, in FIG. 10B, the first visible portion of the shooter S may be at a position X1. However, the position is further from the edge E in FIG. 11B. That is, X2 is greater than X1, which improves the cover for the shooter S by reducing angles from which the shooter may be spotted from below.

Figure 11C:
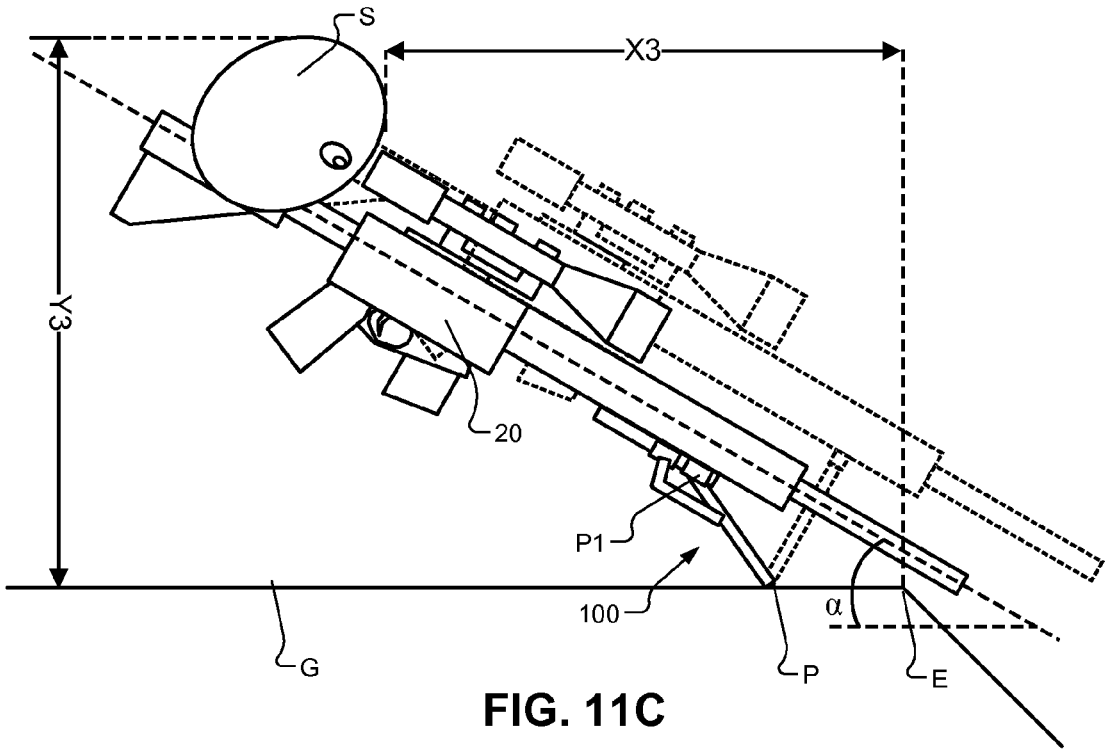
Figure 11D:
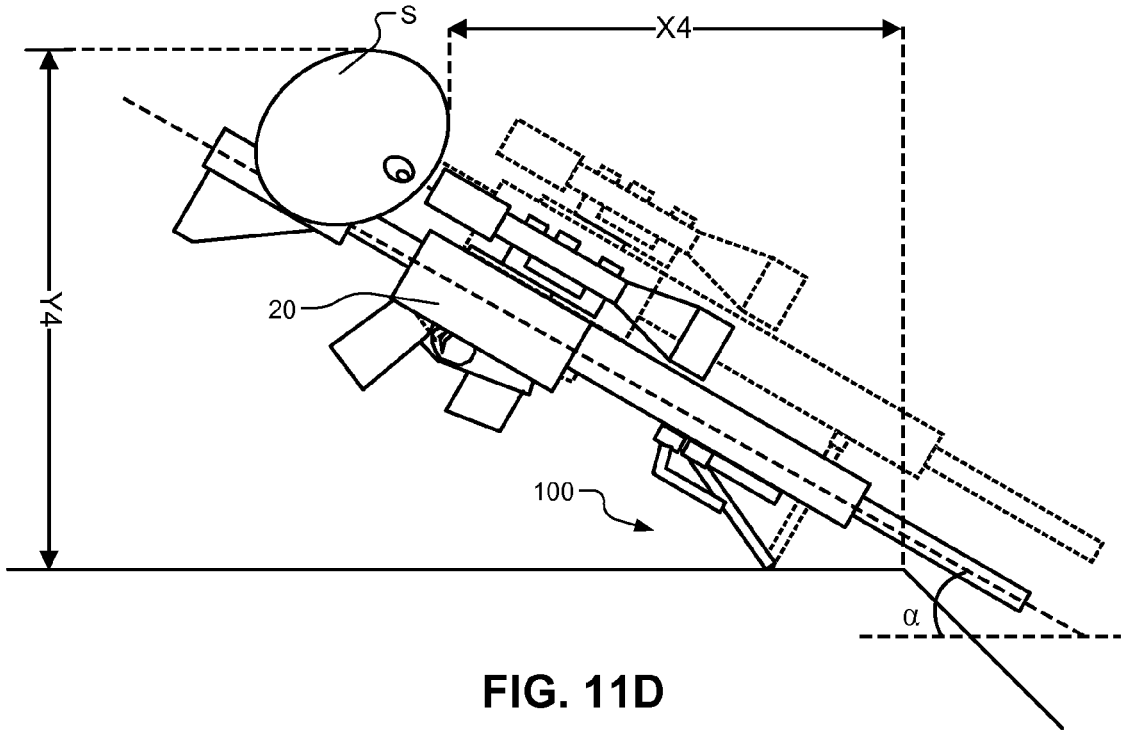

In FIG. 11C, the shooter's exposure has been decreased further as can be clearly seen by the silhouette of the firearm 20 from FIG. 10B shown in dashed lines. The leg housings 108 have been pivoted upward about the first pivot point P1 by bringing the first carriage 102 and second carriage 104 closer together. In addition, the shooter may pivot the bipod 100 about the pivot point P at the ground G. This decreases the height to H3 and allows the shooter S to move further away from the edge E to a distance X3. That is, X3 is greater still than X2 and H3 is less than H2, which further improves the cover for the shooter S by reducing angles from which the shooter may be spotted from below. In FIG. 11D, the shooter's exposure has also been decreased in the vertical direction such that Y4 is less than Y3. However, the distance to the edge has been decreased to X4. It may be desirable in some instances for the shooter S to adjust the exposure depending on the terrain and cover available.

The bipod 100 may be adjusted in numerous ways to adjust the angle of attack α, the horizontal position X of the shooter, and the vertical position Y of the shooter. In this manner, the shooter has increased options to reduce exposure while maintain a stable position from which to target and shoot. The locking mechanisms 120 for both carriages 102 and 104 further ease adjustment of the bipod positioning with a single hand, freeing the shooter's other hand to fire and reducing the need to reposition after adjustment. Likewise, the retention mechanism 140 for both leg housings 108 further ease adjustment of the bipod position with a single hand as well.

Although exemplary bipods herein primarily have been described with reference to firearms, one skilled in the art would readily see the advantages applicable to other devices attached to bipod and supporting structures such as other forms of weaponry (artillery, mortars, etc. In addition, the same benefits and advantages may be useful in non-weapon devices used for photography, videography, astronomy, and the like where a stable mount is desired, with or without the additional benefits of improved cover from a subject of study. Furthermore, bipods, as the name implies, include two legs; however, one skilled in the art would also see that a monopod would benefit from similar features.

Example embodiments of the methods and systems of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

While the invention has been described in connection with various embodiments, it will be understood that the invention is capable of further modifications. This application is intended to cover any variations, uses, or adaptations of the invention following, in general, the principles of the invention, and including such departures from the present disclosure as, within the known and customary practice within the art to which the invention pertains.

The invention claimed is:

1. A bipod for stabilizing a device, comprising:

a rail configured for attachment to the device, the rail including a length extending from a distal end and a proximal end;

a first carriage configured to slidably receive the rail;

a second carriage configured to slidably receive the rail;

a first leg housing having a first upper end pivotally coupled with a first portion of the first carriage and a first mount disposed distal to the first upper end;

a first linking member including a first distal end pivotally coupled with the first mount and a first proximal end pivotally coupled with a first portion of the second carriage;

a second leg housing having a second upper end pivotally coupled with a second portion of the first carriage and a second mount disposed distal to the second upper end; and a second linking member including a second distal end pivotally coupled with the second mount and a second proximal end pivotally coupled with a second portion of the second carriage.

2. The apparatus of claim 1, further comprising a first locking mechanism that selectively prevents translation of the rail relative to the first carriage.

3. The apparatus of claim 2, further comprising a second locking mechanism that selectively prevents translation of the rail relative to the second carriage.

4. The apparatus of claim 3, wherein at least one of the first and second locking mechanisms includes a locking projection that selectively engages a recess of the rail.

5. The apparatus of claim 1, wherein as the first carriage pivots about the upper end of the first leg housing, a distance between the first carriage and the second carriage changes.

6. The apparatus of claim 1, wherein the first linking member includes an angle between the first proximal end and the first distal end.

7. The apparatus of claim 1, wherein the second carriage advances towards the first carriage, the first carriage causes the first leg housing to pivot in a first direction.

8. The apparatus of claim 7, wherein the second carriage advances away from the first carriage, the first carriage causes the first leg housing to pivot in a second direction.

9. The apparatus of claim 1, wherein the first leg housing may be positioned into at least three positions including a stowed configuration, a first deployed configuration, and a second deployed configuration.

10. The apparatus of claim 9, wherein in the stowed configuration, the first leg housing is pivoted in a first direction until aligned with the rail.

11. The apparatus of claim 10, wherein in the first deployed configuration, the first leg housing is pivoted in a second direction to a first angle relative to the rail.

12. The apparatus of claim 11, wherein in the second deployed configuration, the first leg housing is pivoted in one of the first direction and the second direction to a second angle relative to the rail.

13. The apparatus of claim 9, wherein the first leg housing may be locked in any of the at least three positions by selectively engaging at least one of a first locking mechanism of the first carriage and a second locking mechanism of the second carriage with the rail.

14. The apparatus of claim 1, wherein the first carriage and the second carriage may be simultaneously positioned along the rail.

15. A bipod for stabilizing a device, comprising:

a rail configured for attachment to the device, the rail including a length extending from a distal end and a proximal end;

first and second carriages configured to slidably receive the rail;

first and second leg housings, each having an upper end pivotally coupled with the first carriage and a mount disposed distal to the upper end;

first and second linking members, each including a distal end pivotally coupled with a respective mount and a proximal end pivotally coupled with the second carriage; and first and second locking mechanisms that selectively prevent translation of the rail relative to the first carriage and the second carriage respectively.

16. The apparatus of claim 15, wherein the leg housings may be positioned into at least three positions including a stowed configuration, a first deployed configuration, and a second deployed configuration.

17. The apparatus of claim 16, wherein in the stowed configuration, the leg housings are pivoted in a first direction until aligned with the rail.

18. The apparatus of claim 17, wherein in the first deployed configuration, the leg housings are pivoted in a second direction to a first angle relative to the rail.

19. The apparatus of claim 18, wherein in the second deployed configuration, the leg housings are pivoted in one of the first direction and the second direction to a second angle relative to the rail.

* * * * *